US005290109A

United States Patent [19]

Midorikawa

[11] Patent Number: 5,290,109

[45] Date of Patent: Mar. 1, 1994

[54] ELECTRONIC TYPEWRITER FOR PRINTING OF DOCUMENTS HAVING A FIXED FORMAT

[75] Inventor: Hiroshi Midorikawa, Nagano, Japan

[73] Assignee: Seiko Epson Corporation, Tokyo, Japan

[21] Appl. No.: 896,454

[22] Filed: Jun. 4, 1992

Related U.S. Application Data

[63] Continuation of Ser. No. 483,974, Feb. 20, 1990, abandoned, which is a continuation of Ser. No. 135,423, Dec. 21, 1987, abandoned.

[30] Foreign Application Priority Data

Dec. 26, 1986 [JP] Japan ..... 61-314933

[51] Int. Cl.[5] ..... B41J 5/30

[52] U.S. Cl. ..... 400/68; 400/63

[58] Field of Search ..... 364/900; 400/63, 67, 400/68

[56] References Cited

U.S. PATENT DOCUMENTS

| | | | |
|---|---|---|---|
| 3,025,941 | 3/1962 | Blodgett et al. | 400/68 |
| 3,063,536 | 11/1962 | Dirks | 400/67 X |
| 3,380,568 | 4/1968 | Adams et al. | 400/63 |
| 3,413,624 | 11/1968 | Murdoch et al. | 400/68 X |
| 3,696,343 | 10/1972 | Schloss | 400/63 X |
| 4,064,557 | 12/1977 | Bluethman et al. | 400/68 X |
| 4,085,445 | 4/1978 | Blevins et al. | 400/68 X |
| 4,250,560 | 2/1981 | Dethloff et al. | 400/68 X |
| 4,321,670 | 3/1982 | Timmons | 400/67 X |
| 4,441,829 | 4/1984 | Hebert, Jr. et al. | 400/68 X |
| 4,445,795 | 5/1984 | Levine et al. | 400/63 |
| 4,553,860 | 11/1985 | Imaizumi et al. | 400/68 |

OTHER PUBLICATIONS

IBM Technical Disclosure Bulletin, "Improved Technique for Printing Multi-Copy Documents", vol. 29 No. 1 Jun. 1986, pp. 406–407.

IBM Technical Disclosure Bulletin, "Merging Queries and Documents," vol. 29, No. 1 Jun. 1986, pp. 484–486.

IBM Technical Disclosure Bulletin, "Word Processor Having Conditional Text Printing for Mass Mailings," vol. 29 No. 6 Nov. 1986, pp. 2387–2389.

IBM Technical Disclosure Bulletin, "Word-Processing Technique for Merging Lists of Data into a Document", vol. 29 No. 6 Nov. 1986, pp. 2403–2405.

IBM Technical Disclosure Bulletin, "Enhanced Technique for Merging Data from a Second Document", vol. 30 No. 5 Oct. 1987, pp. 184–188.

*Primary Examiner*—David A. Wiecking
*Assistant Examiner*—John S. Hilten
*Attorney, Agent, or Firm*—Blum Kaplan

[57] ABSTRACT

An electronic typewriter for printing a document having a fixed format with portions thereof containing replaceable character code. The document is stored in an external storage device and read out until a replaceable character code is detected. The replaceable character code is acted upon by replacement with substitute character code or deletion thereof based on instructions communicated to a keyboard. Following input of the instructions, the document is once again read out from the external storage device until the next replaceable character code is detected and acted upon. The sequential reading of the document, detection of and acting upon the detected replaceable character code and automatic reading of the remaining portion of the document until detection of the next replaceable character code, continues until the entire document is read out of the external storage device. The entire document can be printed at one time following the input of all information or can be printed one line at a time following the input of information for that particular line.

19 Claims, 9 Drawing Sheets

START
SELECT CHARACTER-CODE
101
READ DOCUMENT
102
END ?
103
YES
NO
110
END
REPLACEABLE CHARACTER-CODE ?
104
NO
YES
105
INPUT INSTRUCTIONS FROM KEYBOARD
EDIT REPLACEABLE CHARACTER-CODE
106
SHOULD BE PRINTED ?
107
NO
YES
109
PRINT OUT
108
STORE DATA

FIG. 5
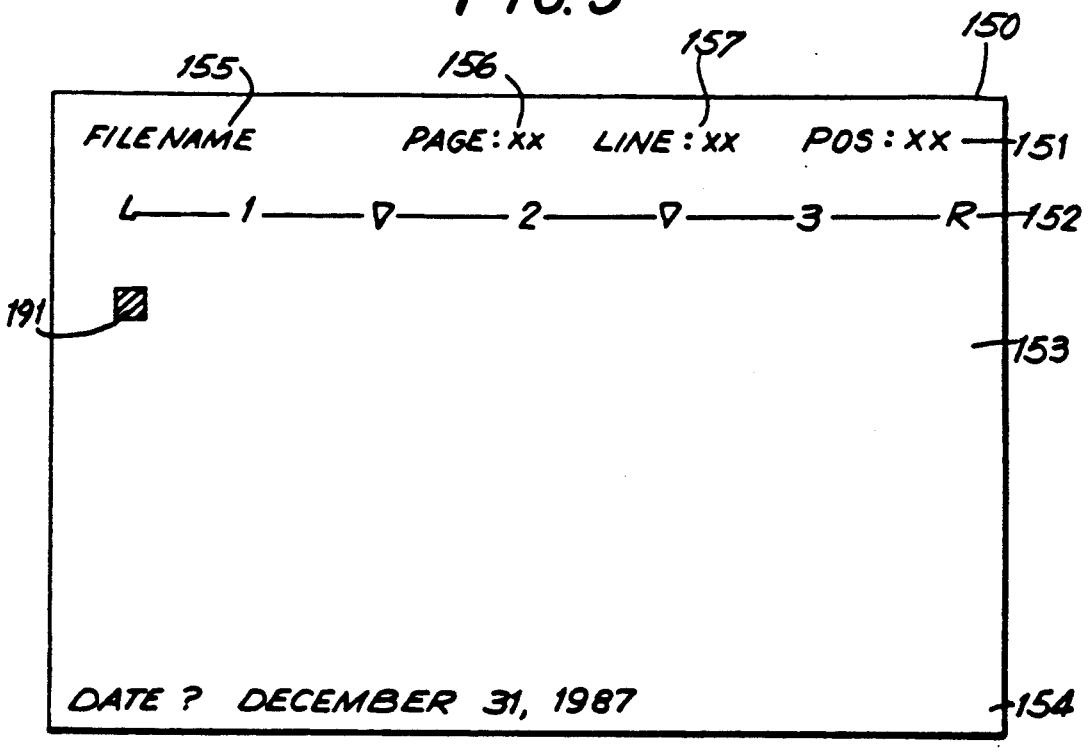
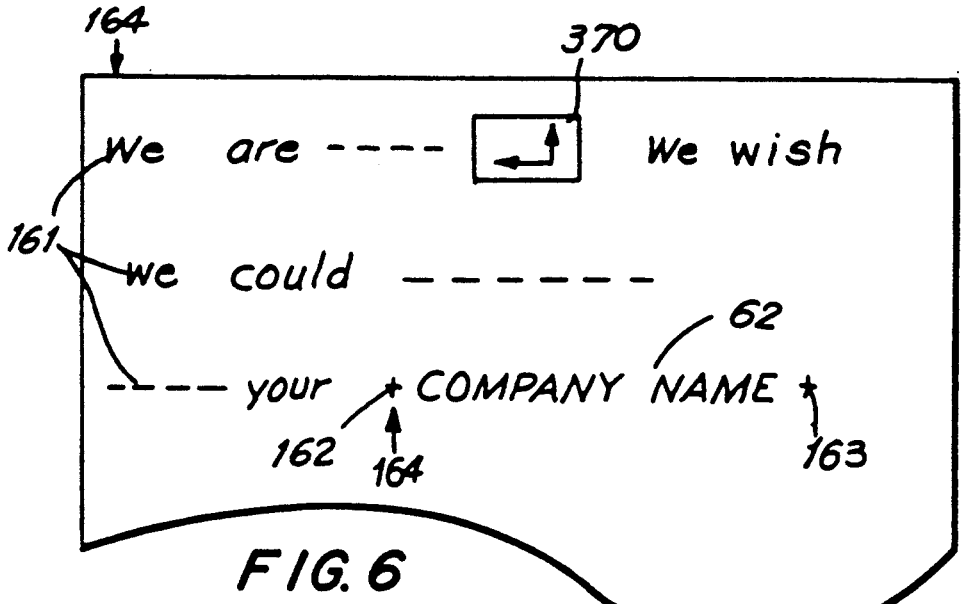
FIG. 6
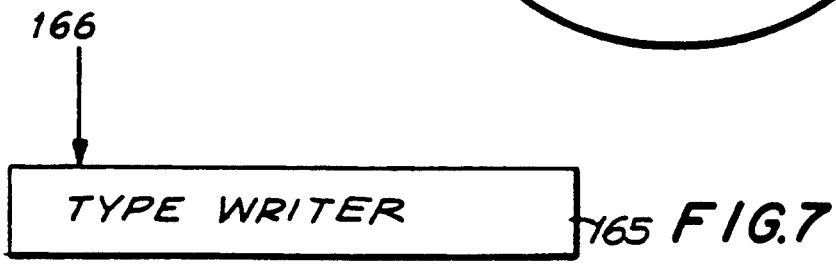
FIG. 7

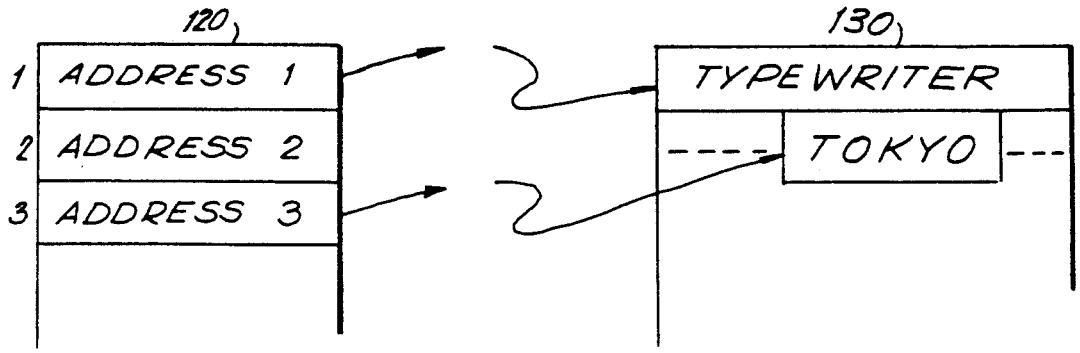
FIG. 12
FIG. 13
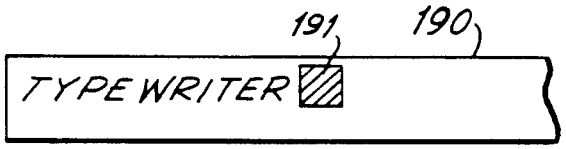
FIG. 15
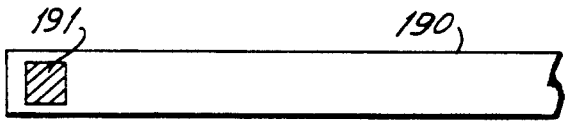
FIG. 14

1100
HEADER
DIRECTORY
1101
DOCUMENTS
1102
ID
1103
ATTRIBUTE
1104
THE NUMBER OF DOCUMENTS
1105
DOCUMENT NAME
1106
ADDRESS
1107
DOCUMENT NAME
ADDRESS
DIRECTORY
1108
DIRECTORY
DIRECTORY

ELECTRONIC TYPEWRITER FOR PRINTING OF DOCUMENTS HAVING A FIXED FORMAT

This is a continuation of application Ser. No. 07/483,974, filed Feb. 20, 1990, which itself is a continuation of application Ser. No. 07/135,423, filed on Dec. 21, 1987, both abandoned.

BACKGROUND OF THE INVENTION

This invention relates generally to an electronic typewriter and, more particularly, to an electronic typewriter for printing documents having fixed formats.

Various business documents, such as, but not limited to, business and legal forms have fixed formats. When such documents are prepared using a conventional typewriter they often need to be typed with reference had to a preprinted similarly formatted document. Unfortunately, an entire new document must be prepared even though there may be only a few differences between the preprinted document and the document to be prepared. In the event that the document to be typed is several pages or more in length, the chances of the typist committing a typographical error or of straying from the fixed format increases, resulting in an unacceptable document which may need to be retyped several times before eliminating all typographical errors and conforming to the fixed format.

Preprinted fill-in-forms which include blank areas to be filled in (e.g. name of an individual, corporation, address etc.) require the typist to move the carriage of the typewriter to the location of each blank area, making it difficult to easily edit such documents. These blank areas also can be too large or too small for the information to be typed therein resulting in a document which may be difficult and/or confusing to read.

Documents having fixed formats also can be printed by a word processing system. Word processing systems which include editing functions for fixed format type documents, however, complicate the word processing system and can be difficult to operate. For documents having fixed formats with few areas to be filled in, such word processors are needlessly burdensome to operate.

Accordingly, it is desirable to provide an electronic typewriter which allows a typist to prepare a document having a fixed format more easily. The typewriter should not require that a typist determine and move the carriage to the exact position in the document for each blank area to be filled in or involve a system which is otherwise difficult to operate.

SUMMARY OF THE INVENTION

Generally speaking, in accordance with the invention, an electronic typewriter includes a keyboard and two storage devices. A first storage device is for storing information supplied through the keyboard based on a category identifier associated with each replaceable character code. The second storage device is for storing documentation having a fixed format and at least one replaceable character code.

The typewriter also includes a reader which reads out the information stored in the second storage device until a replaceable character code is detected. The information contained in the first storage device can be used for substitution of the replaceable character code. Alternatively, information supplied from the keyboard can be used for substitution or deletion of the replaceable character code. Following substitution or deletion of the detected replaceable character code, the reader automatically continues reading the documentation stored in the second storage device until the next replaceable character code is detected. The sequential operation of reading the information stored in the second storage device until the next replaceable character code is detected, acting upon the detected replaceable character code by inputting information through the keyboard or recalling information stored in the first storage device and then automatically continuing to read the information in the second storage device until the next replaceable character code is detected, continues until all information has been read out of the second storage device. Each line of the document is checked and, if necessary, corrected to ensure that the document will conform to the fixed format and to eliminate any unacceptable spacing within each line of the document. In one embodiment of the invention, the printout of the document occurs only after input and recall of all information has taken place. In another embodiment of the invention, printout of the document and input/recall of information occur in a staggered, alternating manner.

Accordingly, it is an object of the invention to provide an improved electronic typewriter for producing a document having a fixed format in which portions thereof are easily edited.

It is another object of the invention to provide an electronic typewriter for producing a document having a fixed format with one or more replaceable character codes and which stores and recalls information initially supplied from a keyboard based on a catgory identifier associated with each replaceable character code.

It is yet another object of the invention to provide an electronic typewriter for producing a document having a fixed format with multiple replaceable character codes which automatically and sequentially detect and display each replaceable character code within the document.

Still other objects and advantages of the invention will in part be obvious and will in part be apparent from the specification.

The invention accordingly comprises the several steps and the relation of one or more of such steps with respect to each of the others, and the apparatus embodying features of construction, a combination of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings in which:

FIG. 5 is a display on a screen of the typewriter;

FIG. 6 are lines of text temporarily held in an internal storage device of the typewriter;

FIG. 7 illustrates a substitute character code stored within a buffer of the typewriter;

FIG. 12 is a look-up table of the internal storage device;

FIG. 13 is a storage region of the internal storage device;

FIGS. 14 and 15 illustrate additional displays shown on the screen of the typewriter.

DESCRIPTION OF THE PREFERRED EMBODIMENTS

Figure 1:
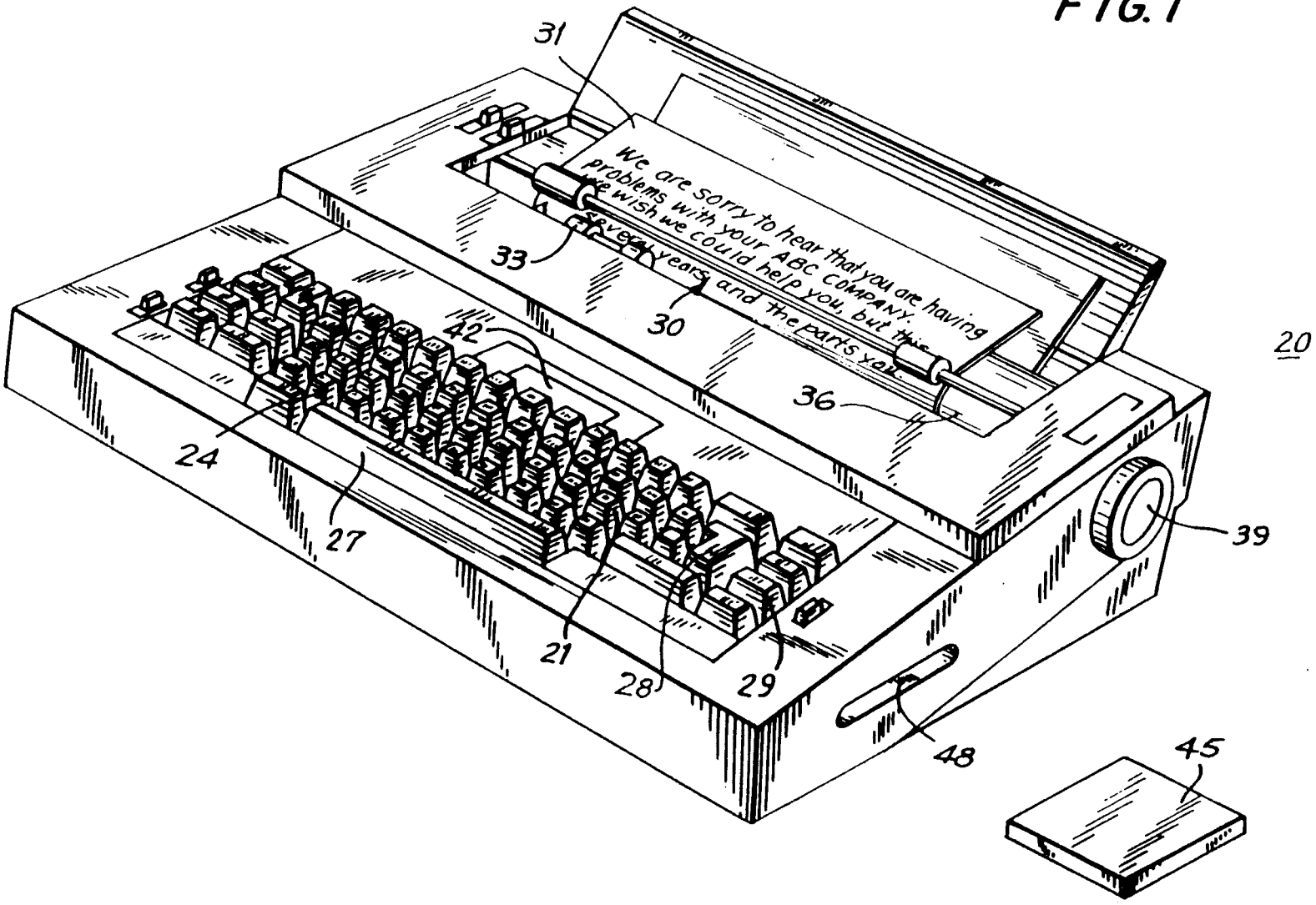
FIG. 1 is a perspective view of an electronic typewriter in accordance with the invention.

Referring to FIG. 1, an electronic typewriter 20 includes a keyboard 21 having a plurality of alphanumeric and symbolic keys 24, a space bar 27 and control keys 29. Keys 24 and space bar 27 are referred to hereinafter as character keys. Typewriter 20 also includes a printing device 30 which can include a daisy wheel type printer, a thermal transfer type printer or other types of well known printing mechanisms. Both the daisy wheel and thermal transfer type printers require a cartridge 33. In the daisy wheel type printer, cartridge 33 has a print wheel, ink ribbon and erasing ribbon (not shown). For the thermal transfer type printer, cartridge 33 includes a thermal transfer head and ink ribbon (not shown). Typewriter 20 also a platen 36 which advances a recording medium such as a piece of paper 31 in front of printing device 30 for printing information (which has been edited) on page 31 in producing an edited document. A knob 39 attached to distal end of platen 36 is used for rotating platen 36 to advance the recording medium. Platen 36 and knob 39 thus serve as a feeding mechanism for the recording medium.

Typewriter 20 also includes a display device 42 for displaying the information communicated to keyboard 21 or stored within typewriter 20. An external storage device 45 having read-only-memory (ROM) or random-access-memory (RAM) is slidably inserted through an opening 48 for interfacing with internal components of typewriter 20 as described below.

Figure 2:
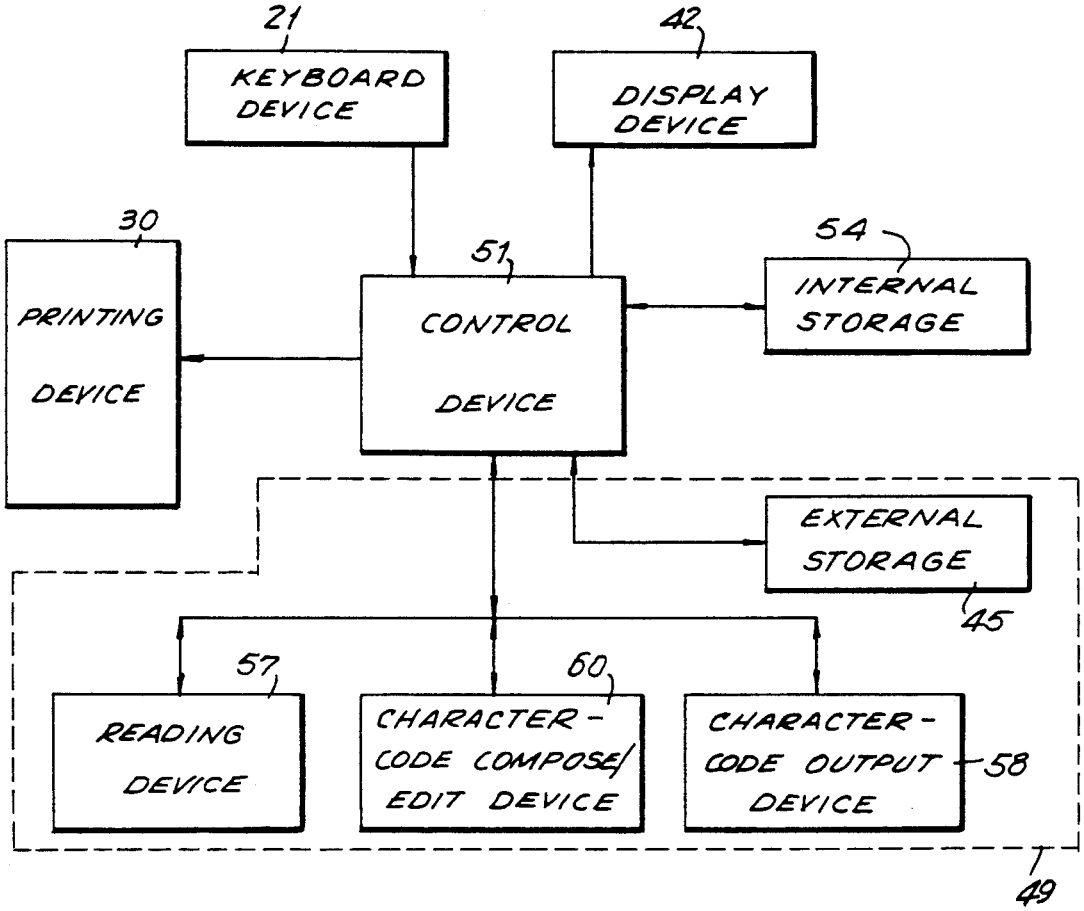
FIG. 2 is a block diagram illustrating the operation of the typewriter.
Figure 3:
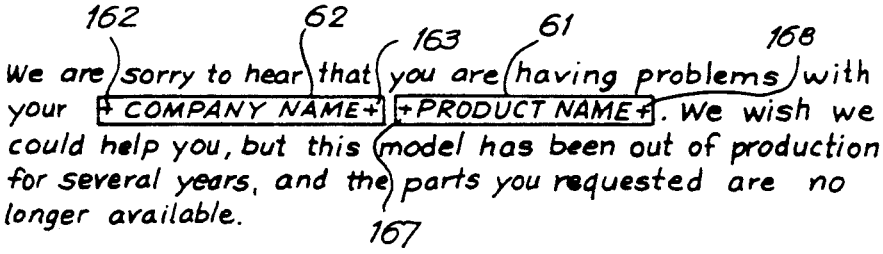
FIG. 3 is a portion of a document displayed on a screen of the typewriter which includes replaceable character codes.

As shown in FIG. 2, operation of typewriter 20 is supervised by a control device 51, such as, but not limited to, a conventional CPU. All decisions which need to be made by the typist are displayed on display device 42. Such decisions involve, but are not limited to, the editing of the document and include the substitution and/or deletion of specific categories of data within the document (hereinafter referred to as replaceable character codes). As shown in FIG. 3, two catagories of replaceable character code include replaceable product name character code 61 and replaceable company name character code 62.

A typist initially instructs control device 51 that a particular document having a fixed format, stored in external storage device 45, is to be printed by typewriter 20. Following confirmation by control device 51 of the document's availability, a reading device 57 begins reading out the document from external storage device 45. The text of the document as it is read out is reviewed by a character code output device 58 to determine if the lines of text read out are ready for printing by printing device 30. If the lines of text are ready for printing, printing device 30 will print the same. When a replaceable character code within the document is detected by reading device 57 as it reads out the document from external storage device 45, reading device 57 interrupts its reading. The replaceable character code detected is displayed on display device 42. The typist inputs through keyboard 21 information to be substituted for the replaceable character code which is then transferred to both an internal storage device 54 and a character code compose/edit device 60. Device 60 then substitutes the information provided by keyboard 21 for the detected replaceable character code. External storage device 45, reading device 57, character code output device 58 and character code compose/edit device 60 are shown within dashed lines 49 and represent that portion of the invention which contains, selects, and edits replaceable character code.

As shown in FIG. 3, replaceable product name character code 61 and replaceable company name character code 62 include control code such as, but not limited to, plus (+) marks 162, 163 and 167, 168, respectively, which indicate the and end of each replaceable character code. Reading device 57, after detecting a consecutive pair of plus (+) signs 162, 163 or 167, 168, temporarily halts reading out of the document as discussed below.

A description of the category associated with each replaceable character code such as product name or company name is typically shown between the beginning and end control codes. The description serves as a guide for the information to be inputted to keyboard 21. It is, however, not necessary to provide this intervening description of the category between the beginning and end control codes. If no intervening description is provided, the pair of plus (+) marks 162, 163 or 167, 168 can be placed adjacent to each other.

Figure 4:
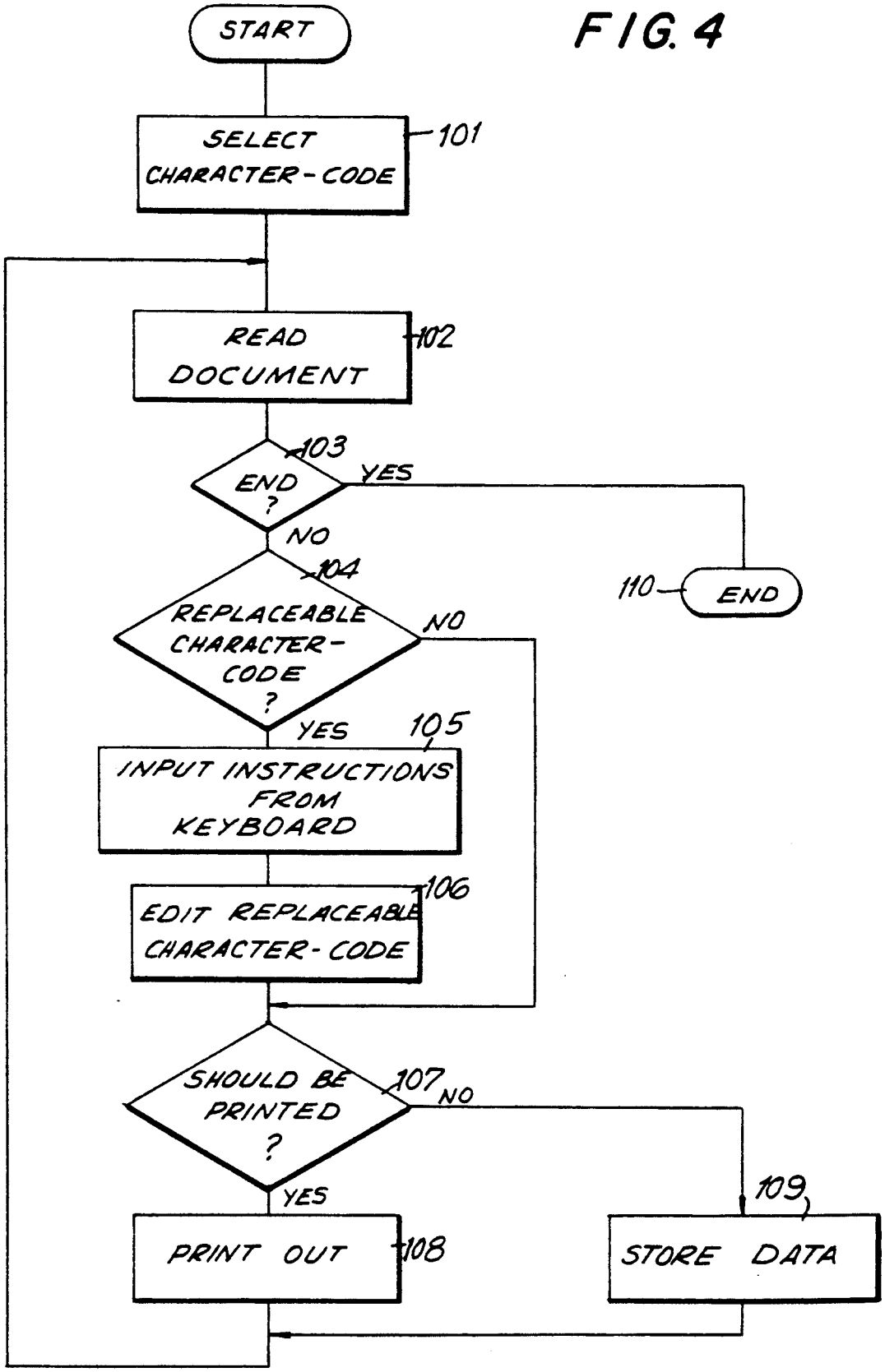
FIG. 4 is a flowchart in accordance with one embodiment of the invention.

FIG. 4 illustrates the step by step operation of typewriter 20. Initially, one or more character codes are displayed on display device 42 which are representative of one or more of the documents stored in external storage device 45. The typist selects from among these one or more character codes as represented by step 101.

Following confirmation of the selected character code, reading device 57 begins reading from the beginning of the document stored in external storage device 45 under step 102. Control device 51 then determines whether reading device 57 has reached the end of the document as represented by step 103. If the entire document already has been read out, operation of typewriter 20 ends as denoted by step 110. If, however, control device 51 does not detect the end of the document, control device 51 checks whether reading device 57 has stopped reading at a replaceable character code as denoted by step 104. If no replaceable character code is detected by control device 51, control device 51 jumps to step 107 which concerns whether to print out the information stored in external storage device 45 or internal storage device 54. If, however, a replaceable character code such as replaceable product name character code 61 or replaceable company name character code 62 is detected, display device 42 will display the same.

The typist with the detected replaceable character code now displayed instructs control device 51 to replace the replaceable character code with substitute character code or to delete the replaceable character code and then skip to the next replaceable character code. Such instructions, are denoted by steps 105 and 106. The character code inputted through keyboard 21 is simultaneously displayed on display device 42, stored in an internal storage device 54 and transferred to character code compose/edit device 60. Character code compose/edit device 60 edits the documentation stored in external storage device 45 by substituting and/or deleting replaceable character codes in accordance with the instructions communicated to keyboard 21.

Prior to transferring a line of the document text to printing device 30 for printing thereof, a character code output device 58 determines whether the information stored in external storage device 45 is ready for transfer to printing device 30 as denoted by step 107. More specifically, prior to typing a line of the document, the line is checked by character code output device 58 to prevent a single word from being printed on two different lines (i.e. word wrap function), to check that the right and left margins are justified and to ensure that the spacing between the substituted character code and the rest of the line of text is properly spaced. In the event that character code output device 58 determines that the line of text is not ready for printing, the line of text is temporarily held in internal storage device 54, as denoted by step 109. In the event that character code output device 58 determines that the line of text from internal storage device 54 or external storage device 45 is ready for printing, the line of text is transferred to printing device 30. The printout of the document is denoted by step 108. Steps 102 through 109 are continually repeated as described heretofore until step 110 is reached.

Display device 42 includes a screen 150 as shown in FIG. 5. Screen 150 includes a status line 151, a ruler line 152, and a text display region 153. Status line 151 includes a title 155 of the document being prepared, a page number 156 indicating the page of the document being shown on screen 150, a line position 157 and other information such as a column number and control information (e.g. insertion mode). Ruler line 152 includes a graduated scale displaying column numbers to indicate the position of a cursor 191 and, if desired, indicia representing tabs and/or margins.

Information stored within external storage device 45 and/or internal storage device 54 is displayed on screen 150 within text display region 153. Cursor 191 is used for pointing to a specific portion within the text of the document displayed on screen 150. Substitute character codes to be used in place of the replaceable character codes are added to screen 150 one character at a time in the form of reversal display or the like, (i.e. starting with the last character in the substitute character code).

An input line 154 appearing at the bottom of screen 150 can include replaceable character codes displayed as a prompt message and/or instructions communicated through keyboard 21 such as a substitute character code to be used in place of the replaceable character codes.

Referring now to FIG. 6, a sample of several typical lines 161 of text stored within internal storage device 54 are shown. Control codes 162 and 163 are shown as plus (+) marks representing the beginning and end of replaceable company name character code 62, respectively. A text editing pointer 164 indicates the position in internal storage device 54 which can be edited by control device 51.

Information communicated to keyboard 21 is stored in a keyboard buffer 165. A buffer pointer 166 keeps track of the position in which information is being placed into buffer 165 and is used for subsequently transferring the information from buffer 165 to internal storage device 54. Control device 51 controls the printing of the document stored in internal storage device 54 in the same order as pointer 164 advances. For each character printed, pointer 164 is advanced by one character.

Generally, information inputted into keyboard 21 includes., but is not limited to, data which will be substituted for the replaceable character code (i.e. substitute character code) and instructions regarding deletion of the replaceable character code or operation of printing device 30.

Figure 8:
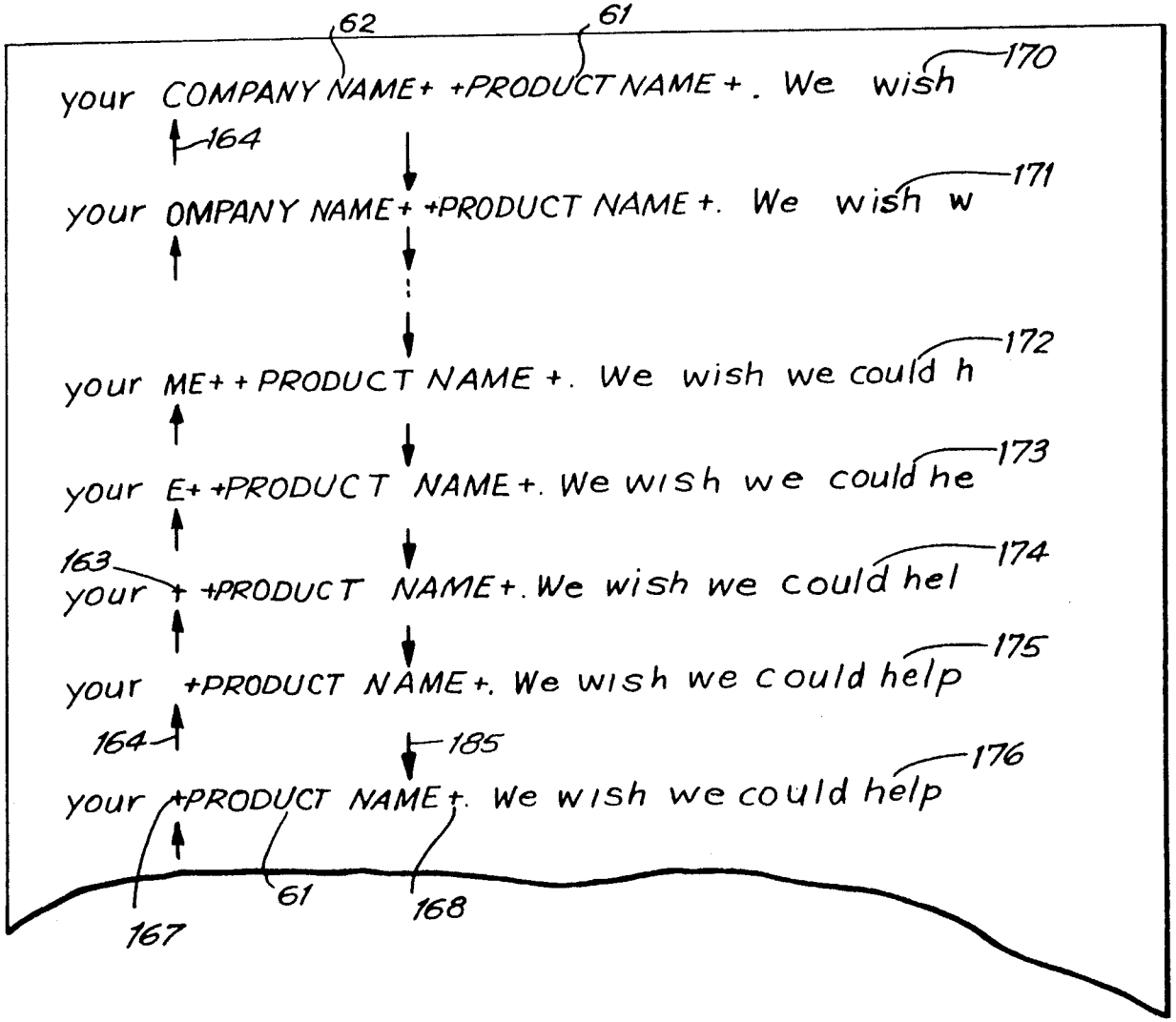
FIG. 8 illustrates the sequential deletion of a replaceable character code stored within the internal storage device of the typewriter.

FIG. 8 illustrates the deletion of replaceable character code. Lines 170–176 show the sequential steps involved in deleting replaceable company name character code 62. Line 170 represents the line of information prior to deletion of the first character of replaceable company name character code 62. Pointer 164 indicates the particular character within replaceable company name character code 62 which will be deleted by control device 51 in accordance with instructions inputted to keyboard 21. Each time a character is deleted from replaceable company name character code 62, the remaining portion of the line of text stored within internal storage device 54 is shifted one character to the left. Once control code 163 is deleted as indicated on line 175, both text pointer 164 and another text pointer 185 are checked by control device 51 to determine whether unnecessary spacing, a comma or the like exists between replaceable product name character code 61 and the rest of the line of text. As shown on line 175, two spaces rather than one space exists between the letter "r" in the word "your" and control code 167. Accordingly, one space is deleted to produce line 176.

Instructions other than the input of data can be communicated to keyboard 21 by depression of other than a character key 24, 27 such as, but not limited to, depression of a carrier return/line feed key 28 (represented by a return key code 370 in FIG. 6). For example, control device 51 can be directed to skip over replacing replaceable character code by directing the deletion of the same. When the key code 370 is detected within internal storage device 54, a printing head (not shown) is set for a new paragraph line. Control device 51 in response to the detection of key code 370 temporarily halts printing of the document by printing device 30.

When two return key codes 370 are adjacent to one another, for example, due to deletion of a replaceable character code, control device 51 through positioning of pointers 164 and 185 will identify the same and will delete one of the adjacent key codes 370. Consequently, a line of text will be shifted line upwardly.

When data is communicated to keyboard 21 by depression of one or more character keys 24, 27, the data is transferred to and placed in a specific register of keyboard buffer 165 indicated by pointer 166. Accordingly, as data is transferred to keyboard buffer 165, pointer 166 advances from the position shown in FIG. 7 to the right. Once entry of the data is complete, the carrier return/line feed key is depressed. Control device 51 recognizing that depression of the carrier return/line feed key now represents the end of the data entry will transfer the data stored in keyboard buffer 165 to internal storage device 54 as follows. Transfer of each character stored within keyboard buffer 165 to internal storage device 54 is based on the position of pointer 166.

More specifically, the character indicated by pointer 166 is transferred to character line 161 by first shifting line 161 one character to the right from the position indicated by pointer 164. Then the character indicated by pointer 166 in keyboard buffer 165 is transferred to internal storage device 54 in the position indicated by pointer 164.

In transferring the data, pointer 164 begins next to and to the left of the control code representing the end of the replaceable character code (e.g. plus (+) marks 163 and 168). Pointer 166 begins at the last position in which data has been stored in buffer 165. Therefore, transfer of data stored from buffer 165 to internal storage device 54 continues by shifting line 161 one character to the right for each character stored in buffer 165. In the event that the information stored in buffer 165 is too long for one line of printed text, the information stored in buffer 165 is transferred to internal storage device 54 so as to represent two lines of printed text.

A computer program, written in C programming language, listing the operation of typewriter 20 is shown in Table 1. For printing out the edited documents, printing device 30 is initialized by the set of program lines 201. In arranging the document to set up the right and left margin justifications, a message "Reforming" is displayed on screen 150 represented by program lines 202. The steps involved in initializing pointer 164 are denoted by program lines 203 and the steps, involved in setting pointer 164 at the beginning of the document are listed by program lines 204. Once screen 150 is initialized, and the necessary information shown in FIG. 5 is displayed, the text and the cursor 191 are then displayed at the beginning of the document as denoted by program lines 205, 206 and 207. If pointer 164 indicates that it is at the end of the document, the document has been printed. If pointer 164 indicates that it is not at the end of the document, the remaining data is checked by control device 51 to determine if the rest of the document is ready for printing. If pointer 164 indicates that it is at the beginning of a replaceable character code, input line 154 is cleared and prepared for new input denoted by program lines 208.

A replaceable character code is displayed on input line 154 by program lines 209. Text cursor 191 is set on input line 154 by program lines 210. Input of information due to depression of the character keys 24, 27 on keyboard 21 is accomplished by program lines 211. In deleting replaceable characters codes, pointer 164 is reset at the beginning of the replaceable character code by program lines 212 and deleted by program lines 213. Editing of the document to conform to the left and right margins after substitution of replaceable character code is denoted by program lines 214. Confirmation as to whether data to be printed exists and the printing of such existing data is denoted by program lines 215. When a typist depresses only carrier return/line feed key 28, the spaces and commas on either side of the replaceable carrier code are deleted by program lines 216. If the only character code indicated by text pointer 164 on a line to be printed is key code 370, the line is deleted as denoted by program lines 217. Moving of text pointer 164 one space forward is represented by program lines 218 and is repeated following program lines 208 until text pointer 164 reaches the end of the document. Once text pointer 164 indicates that it is at the end of the document, confirmation as to whether the data to be printed exists, the printing of such existing data and deletion of all unnecessary information stored in internal storage device 54 is denoted by program lines 219.

Figure 9:
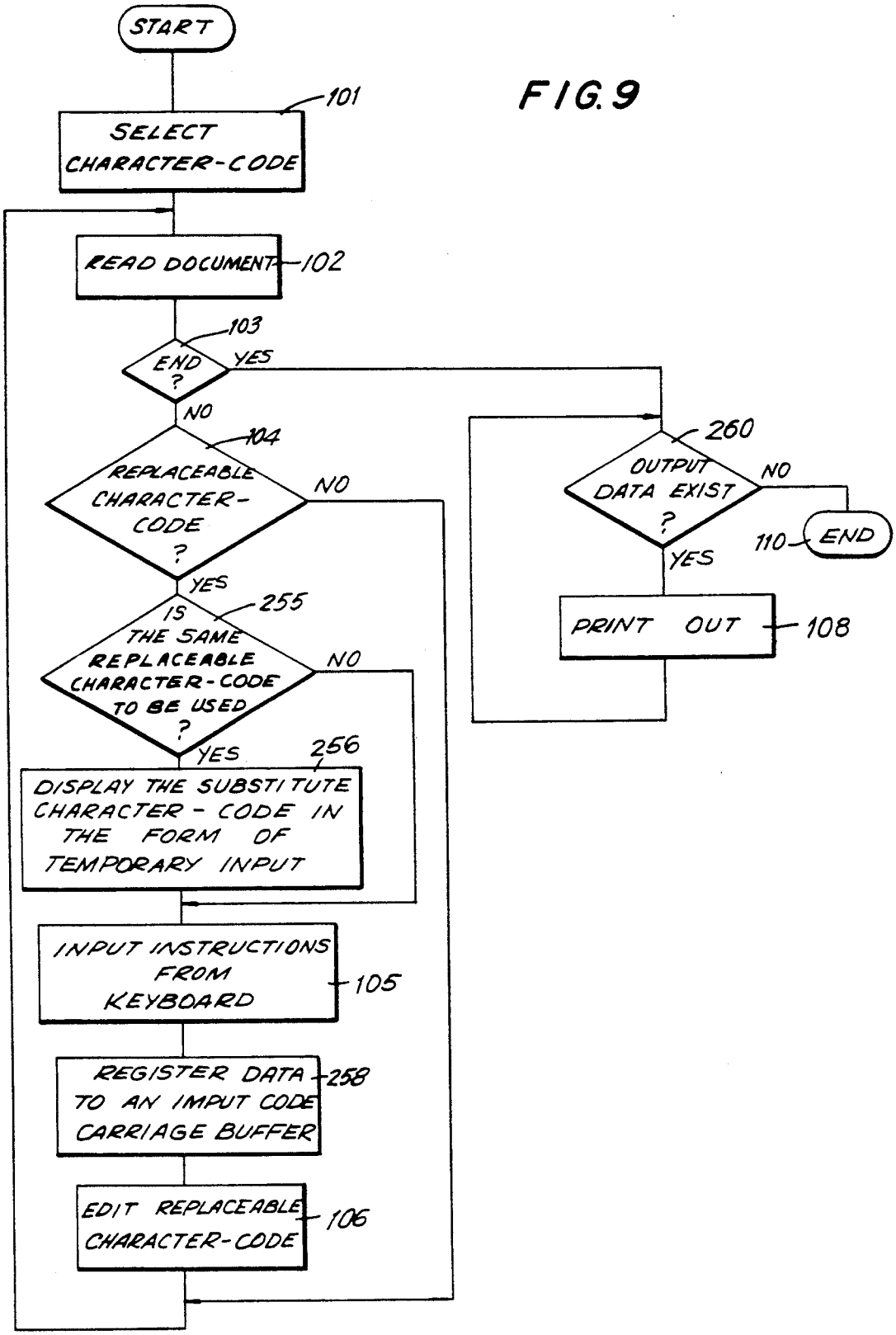
FIG. 9 is a flowchart in accordance with an alternative embodiment of the invention.

FIG. 9 illustrates an alternative flowchart scheme to the flowchart scheme of FIG. 4. In FIG. 9 all information is communicated to keyboard 21 followed by the printing of the entire document by printing device 30 rather than flip-flopping between input of information to keyboard 21 and printing of portions of the document as shown in FIG. 4. Steps similar to FIG. 4 are identified by the same reference numerals. Thus, steps 101, 102, 103, 104, 105 and 106 as shown in FIG. 4 will not be further described below. The flowchart scheme of FIG. 9 between steps 101–104 is exactly the same as in FIG. 4. However, in the event that no replaceable character code is detected under step 104, the flowchart scheme of FIG. 9 jumps back to reading out the document stored in external storage device 45 by reading device 57 as denoted by step 102. If the replaceable character code is detected by reading device 57, control device 51 determines whether a substitute character code has been inputted previously under step 255 by checking with internal storage device 54.

If control device 51 determines that the same replaceable character code has been inputted previously, the previous input for this replaceable character code is displayed on screen 150 as a temporary input under step 256 (e.g. "typewriter"). An exemplary display of screen 150 prior to and after step 256 is shown in FIGS. 14 and 15, respectively.

The typist then decides whether "typewriter" is to be substituted for code 61 again. Assuming that "typewriter" is still acceptable, the typist depresses the carrier return/line feed key which control device 51 recognizes as the input "typewriter↵" under step 105. In other words, under the flowchart scheme of FIG. 9 there is no need to retype the same substitute character code.

In the event that the detected replaceable character code, for example, replaceable product name character code 61, has not occurred previously in the document, the typist inputs a particular product name such as "typewriter" to be substituted for code 61 as denoted by step 105. When inputting substitute character code through keyboard 21, the information can be simultaneously edited by back spacing, repositioning cursor 191 or the like on screen 150.

The substitute character code is then registered in a carriage buffer 165 as denoted by step 258. Character code compose/edit device 60 replaces replaceable character (e.g. code 61) in the document with the substitute character code (i.e. "typewriter") inputted into keyboard 21 as denoted by step 106. Following such editing, control device 51 once again directs reader 57 to read out the information from external storage device 45 as denoted by step 102.

Once control device 51 detects the end of the document under step 103, the document is checked and corrected, if necessary, by character code output device 58 and then transferred to printing device 30 beginning with the first line of the document under step 260. The document is printed under step 108. Once the entire document has been printed, operation of typewriter 20 ends (step 110).

The flowchart scheme of FIG. 9 is considered superior to the flowchart scheme of FIG. 4. More specifically, since the input of all information is completed at one time which is followed by the printing of the entire document at one time, preparation of the document is accomplished in less time.

Figure 10:
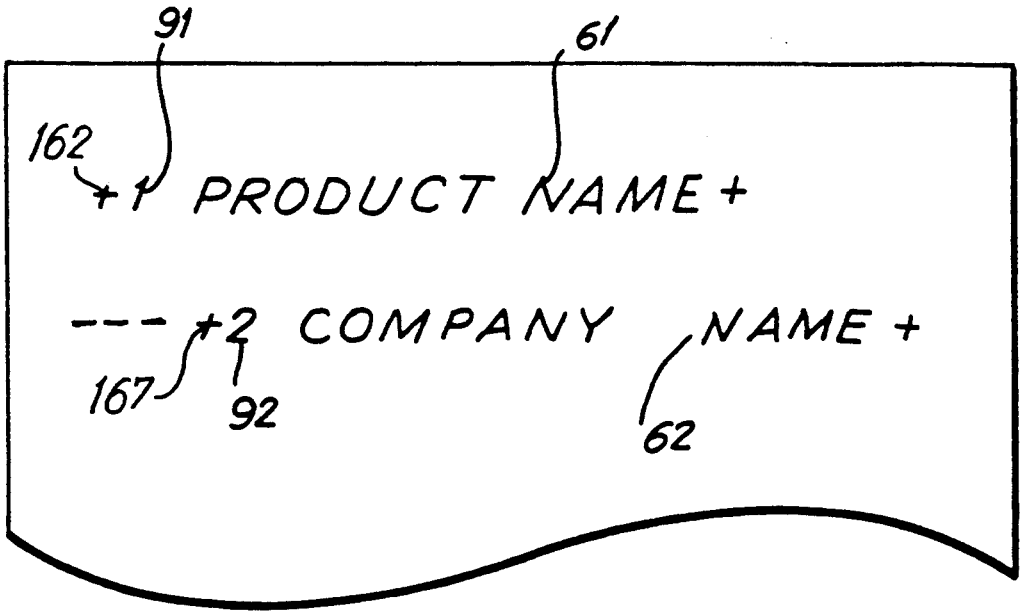
FIG. 10 illustrates replaceable character codes displayed on the screen of the typewriter.

FIG. 10 illustrates replaceable product name character code 61 and replaceable company name character code 62 as shown on screen 150. Immediately following control codes 162 and 167 are category identifiers 91 and 92. Category identifiers 91 and 92 represent the type of information to be substituted for replaceable product name character code 61 and replaceable company name character code 62, respectively. Control device 51 uses category identifiers 91 and 92 to determine the position within internal storage device 54 in which each substitute character code is to be stored.

Figure 11:
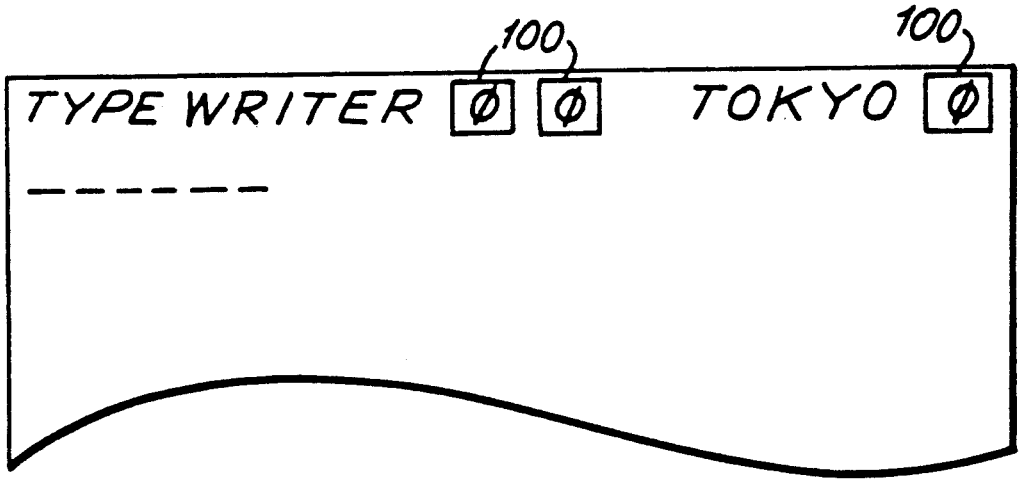
FIG. 11 illustrates substitute character codes stored within the internal storage device of the typewriter.

For example, as shown in FIG. 11, each type of substitute character code is separated by delimiters 100. The numerical value of category number 91 or 92 indicates the look up address in a look-up table 120 (FIG. 12) for locating the substitute character codes stored in a storage region 130 (FIG. 13). Both look-up table 120 and storage region 130 are in internal storage device 54. If pointer 164 were positioned to indicate character code 92, control device 51 would check the second address in look-up table 120 to determine the location within internal storage device 54 of the substitute character code for replaceable company name character code 62. As shown in FIG. 12, the second address in look up table 120 is address 2. Control device 51 looks for address 2, by counting the number of delimiters 100 in sequential order. Address 2 appears between the first delimiter 100 and the second delimiter 100.

As shown in FIG. 11, no unit of data is stored between the first and second delimiters 100, that is, no substitute character code has been inputted into keyboard 21. Therefore, only text cursor 191 on screen 150 would appear as shown in FIG. 14.

As now can be appreciated, the registration of each unit of data (i.e. substitute character code) within internal storage device 54 is based on the category identifier associated with each replaceable character code. In the event that no data for a particular address is yet stored in storage region 130 (i.e. the substitute character has not been registered), the address given in Table 120 will be FFFFH.

Figure 16:
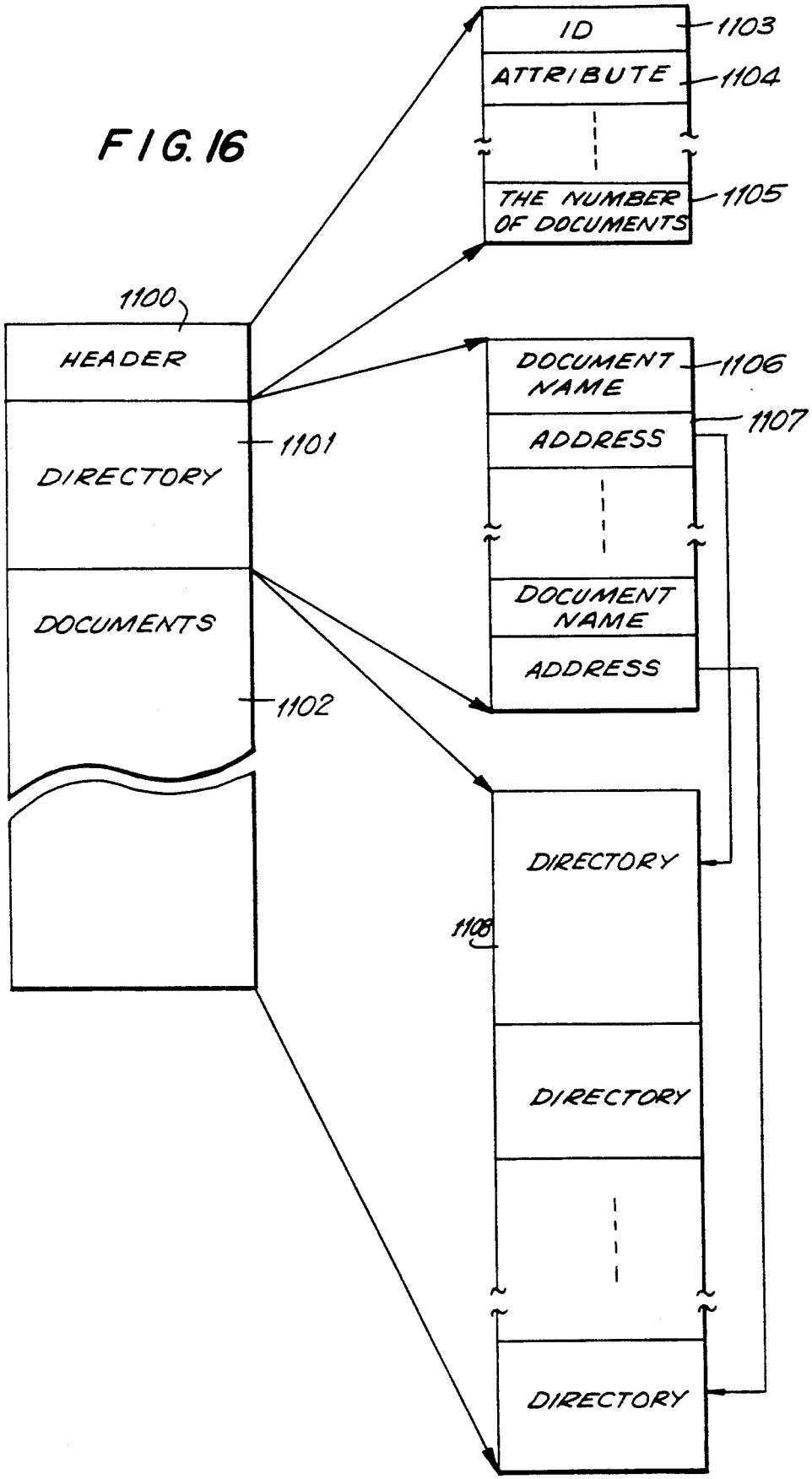
FIG. 16 illustrates diagrammatically the internal structure of an external storage device.

As shown in FIG. 16, the structure of external storage device 45 includes a header 1100, a directory 1101 and document section 1102. Header 1100 includes information required for all documents such as identification number 1103, attribute 1104 and the number of documents 1105 stored in external storage device 45. Directory 1101 includes, for each document, a document name 1106 and a document address 1107. Directory 1101 provides high speed access to any document. Each document within document section 1102 also includes a directory 1108 which is used for determining the format of each document to be printed and contents thereof.

Although typewriter 20 has been described using keyboard 21 for inputting information, other suitable input devices can be used including oral/mouth and phonetic inputs. Furthermore, typewriter 20 is not restricted to any particular type or size of display screen 150. The display screen 150, may be, for instance, a liquid crystal display. Use of the display screen 150 for displaying data as it is communicated to keyboard 21 is optional. Completed documents also may be displayed on a screen 150 as they are being printed. Typewriter 20 can include a modem for inputting information from a keyboard through a telephone line to control device 51. Data to be printed can be transmitted to a peripheral printer.

As now can be readily appreciated, typewriter 20 provides a typist with a simple and quick method for revising a document having a fixed format. Addition and deletion of information within the document can be easily accomplished by the typist without having to locate the proper position for insertion of such information. Furthermore, external storage device 45 can be built to accommodate a plurality of different documents each having different fixed formats. Reading of the document by reading device 57 is performed so as to automatically halt once a replaceable character code is detected and to automatically continue reading the document once the typist acts upon the replaceable character code detected. Consequently, editing of the document proceeds quickly and is easily accomplished by the typist.

Internal storage device 54 and external storage device 45 are not restricted to any particular form or type of storage device and include, but are not limited to, storage medium (e.g. floppy disc, IC memory, magnetic bubbles, etc.) and attribute (e.g. read only memory,one time writable memory,random access memory, etc.). It is also not necessary to clearly distinguish between internal storage device 54 and external storage device 45 during operation of typewriter 20. More specifically, the invention as described above begins with the document initially stored within external storage device 45. Thereafter, if the line of text of the document is not ready for printing it is transferred to and kept in internal storage device 54 until it is ready to be transferred to printing device 30. If desired, however, internal storage device 54 need not be used at all with all deletions, substitutions and other modifications to the document being stored within external storage device 45.

It will thus be seen that the objects set forth above, and those made apparent in the preceding description are efficiently attained, and, since certain changes may be made in the above method and construction set forth without departing from the spirit and scope of the invention, it is intended, that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention, which, as a matter of language, might be said to fall therebetween.

TABLE 1

```
1055: {
1056:
1057:   if (smaflg != 2)
1058:   {
1059:     if (ortint((char)0,gchrpt,glnsoc,gleftm) != 0×00) /* init printer */
1060:     {
1061:       smaerp( );
1062:       return(ERR);
1063:     }
```

201

TABLE 1-continued

```
1064:   }
1065:
1066:   /* reform and move cursor to top here */
1067:
1068: smorst( );                /* reset cursor attribute */
1069: cbkde_((char)0,ghdlin-1,ghdcol,(char)1);  /* erase last line */   202
1070: mgdspa((char)10,ghdlin-1,&smafmt);
1071:
1072: hottop(chanel);
1073: hotrgh(chanel);
1074: hotovr(chanel,gleftm);
1075: hotrgh(chanel);
1076: hotovr(chanel,grigtm);
1077: hotrgh(chanel);
1078: hotovr(chanel,gleftm);
1079: hotrgh(chanel);
1080: hotovr(chanel,grigtm);
1081: hotrgh(chanel);
1082: hotrgh(chanel);                                                  203
      hotovr(chanel,grigtm);
      hotrgh(chanel);
      hotrgh(chanel);
      hotrgh(chanel);
      hotovr(chanel,gfontn);
      hotrgh(chanel);
      hotovr(chanel,gfontn);
      hotrgh(chanel);
      hotrgh(chanel);
      hottop(chanel);
      gcurst = 0;
      funini( );
      hottop(chanel);
      hotrgn(chanel,(int)10);
      while (((dumyin = hotchr(chanel)) < 0×20) && (dumyin != 0×0d))   204
      {
        hotrgh(chanel);
      }
      smarfm( );            /* reform */
      hottop(chanel);          /* cursor to top */
      funini( );
      dosfil(gfilno);                                                  205
      dosall( );
      while (((dumyin = hotchr(chanel)) < 0×20) && (dumyin != 0×0d))
      {
        hotrgh(chanel);
      }                                                                206
      prntpg = prntln = 1;
      if (dumyin == 0×0d)
      {
        smalng = 0×0d;
      }
      else
      {
        smalng = 0×20;                                                 207
      }
      smaoff = gleftm;
      smaxyz[0] = 0×0e;
      smaxyz[1] = smaxyz[2]= gfontn;
      smaxyz[3] = 0×1e;
      while (0 != hotchr(chanel))
      {
        if (smaout( ) == ERR)
        {
          smaerp( );
          return(ERR);
        }
        hotlft(chanel);
        if ((dumyin = hotchr(chanel)) == 0×0f)                         208
        {
          hotrgh(chanel);
          funnsr( );
          fundrw( );
      ccurp_((char)0,ghdlin-1);
      smorst( );            /* reset cursor attribute */
      cbkde_((char)0,ghdlin-1,ghdcol,(char)1);  /* clear line */
      cbold_((char)0);              /* bold on */
      while ((dumyin = hotchr(chanel)) != 0×1f)
      {
        if (dumyin >= ' ')
        {                                                              209
          conou_(dumyin);
        }
```

TABLE 1-continued

```
  hotrgh(chanel);
}
conou_((char)0×20);
conou_((char)0×3f);
conou_((char)0×20);          /* ? */
cbold_((char)0);             /* bold off */                    210
crdcu_(&smaxpo,&smaypo);  /* get cursor position */
girflg = 0×ff;               /* pop up enable */
giword = 0×20;
while (adostr((char)97,&smastr[0],&gnegsp) == ERR)
{
  smorst( );
  ccurp_(smaxpo,smaypo);
  for (i = 0; i < 80; i++)
  {
    conou_((char)0×20);
  }
  ccurp_(smaxpo,smaypo);
  mgdspa(smaxpo,smaypo,&smaays);                              211
  if ((adcchr(&dumyin,&gnegch) != ERR) &&
    ((dumyin == 'Y') || (dumyin == 'y')))
  {
    hotrmv(&gfname);
    return(0×00);
  }
  mgdspa(smaxpo,smaypo,&smanul);
  ccurp_(smaxpo,smaypo);
  smorst( );
}
girflg =0×00;                /* pop up disable */
strpnt = &smastr[0];
while (hotchr(chanel) != 0×0f)    /* back to top of generic *
{
  hotlft(chanel);                                             212
}
hotdel(chanel);
hotrgh(chanel);
hotrgh(chanel);
  funnsr( );
  grefrm = 0;        /* auto align off */
  while (hotchr(chanel) != 0×1f)
  {
    fundch( );
    hotrgh(chanel);                                           213
    funnsr( );
    if (hotchr(chanel) == 0×1d)
    {
      funcrg( );
    }
  }
  hotdel(chanel);
  hotrgh(chanel);                                             214
  funnsr( );
  grefrm = 1;                /* auto align on again */
  fundch( );
  if (*strpnt != 0)
  {
    while (*strpnt != 0)
    {
      if (funitx(*strpnt) == ERR)
      {
        smaerm( );
        return(ERR);                                          215
      }
      if (smaout( ) == ERR)
      {
        smaerp( );
        return(ERR);
      }
      strpnt++;
    }
}
else
{
  while (((dumyin = hotchr(chanel)) == ' ') || (dumyin == ',')
    || (dumyin == '-'))
    {
      funcrg( );                                              216
      fundch( );
    }
  }
  while (((dumyin = hotchr(chanel)) != 0×0d) && (dumyin != 0×1d)
```

TABLE 1-continued

```
        && (dumyin < 0×20))                                  } 217
      {
        hotrgh(chanel);
      }
    }
    else
    {
      hotrgh(chanel);
      if (hotchr(chanel) == 0×0d)
        {
          hotlft(chanel);
          if (((hotchr(chanel) == 0×0d) || (hotchr(chanel) == 0×1e))
                    && (smalng != 0×0d))
          {
            hotrgh(chanel);
            funcrg( );
            fundch( );
            smalng = hotchr(chanel);
          }
          else
          {                                                  } 218
            hotrgh(chanel);
            funcrg( );
          }
        }
        else
        {
          funcrg( );
        }
      }
    }
    smaout( );          /* print last line */
    hotcls(chanel);       /* close file*/
    if (smaflg == 1)        /* output is only printer ? */
    {
      hotrmv(&gfname);                                       } 219
    }
    return(0);
  }
```

What is claimed is:

1. An electronic document producing apparatus comprising:

input means for supplying information to the apparatus;

a first storage device for storing documentation having a fixed format and containing multiple replaceable character codes;

reading means for reading the documentation stored in said first storage device;

display means for displaying documentation read by said reading means and information supplied to said input means;

control means for halting the reading of said documentation by said reading means upon detection of each replaceable character code;

prompting means for prompting a user to input the information according to said detection;

first deleting means for deleting said replaceable character code;

second deleting means for examining whether unnecessary codes including space exist or not and deleting the unnecessary codes including space after the deletion of the replaceable character code;

a second storage device for storing the information supplied to said input means by the user;

inserting means for inserting the information stored in said second storage device into the documentation as a substitution of said replaceable character code;

means for examining the document surrounding a position in the document where the replaceable character code existed and deleting unnecessary codes if a code indicating that there is no input of information is input;

printing means for producing an edited document based on said documentation and said information;

wherein said display means is operable for displaying said documentation read by said reading means and said information supplied by said input means prior to production of said edited document by said printing means.

2. A method of printing by an electronic document producing apparatus of a document having a fixed format and multiple replaceable character codes comprising the steps of:

storing the document in a first storage device;

reading the document stored in the first storage device;

displaying at least a portion of the documentation read including the multiple replaceable character cods;

halting the reading of the document upon detection of each replaceable character code;

deleting said replaceable character code;

prompting a user to input the information according to said detection;

inputting information by the user based on the portion of the document displayed;

storing the input information in a second storage device;

inserting the information stored in said second storage device into the documentation as a substitution of said replaceable character code;

printing the document based on said information;

wherein the displaying of said portion of the documentation occurs prior to printing.

3. The method of claim 2, wherein printing of the document follows editing of the document.

4. The method of claim 3, further including determining whether each replaceable character code read has been previously detected.

5. The method of claim 4, further including displaying information stored in the second storage device prior to printing which is associated with previously detected replaceable character codes.

6. The method of claim 3, further including inputting all information required in the document prior to printing of the document.

7. The method of claim 3, further including inputting only a portion of information required in the document prior to printing of the document.

8. A method for printing by an electronic document producing apparatus of a document having a fixed format and containing multiple replaceable character codes comprising the steps of:

storing the document in a storage device;

reading the document stored in the storage device;

displaying at least a portion of the document read including the multiple replaceable character codes;

halting the reading of the document upon detection of each replaceable character code;

deleting firstly said replaceable character code;

prompting a user to input the information according to detection;

examining whether unnecessary codes including spaces exist or not and deleting the unnecessary codes including space after the deletion of the replaceable character code;

inputting information by the user based on the portion of the document displayed;

storing the input information in another storage device;

inserting the information stored in said another storage device into the document as a substitution of said replaceable character code; and printing the document based on the information;

wherein displaying of said portion of the document occurs prior to the printing.

9. The method of claim 8, further including assigning a category identifier to each replaceable character code.

10. The method of claim 9, further including storing the information in another storage device based on at least one category identifier.

11. The method of claim 10, further including displaying information stored in said another storage device which is associated with previously detected replaceable character codes.

12. The method of claim 10, further including editing the document so as to conform to said fixed format.

13. The method of claim 12, wherein printing of the document follows editing of the document.

14. The method of claim 13, further including determining whether each replaceable character code read has been previously detected.

15. The method of claim 13, further including inputting all information required in the document prior to printing of the document.

16. The method of claim 13, further including inputting only a portion of the information required in the document prior to printing of the document.

17. A method of printing by an electronic document producing apparatus of a document having a fixed format and multiple replaceable character codes, comprising:

storing the document in a first storage device;

reading the document stored in the first storage device;

displaying at least a portion of the document read including the multiple replaceable character codes;

halting the reading of the document upon detection of each replaceable character code;

deleting firstly said replaceable character code;

prompting a user to input the information according to said detection;

examining whether unnecessary codes including space exist or not and deleting secondly the unnecessary codes including space after the deletion of the replaceable character code;

inputting information by the user based on the portion of the document displayed;

storing the input information in a second storage device;

inserting the information stored in said second storage device into the document as a substitution of said replaceable character code;

examining the document surrounding a position in the document where the replaceable character code existed and deleting the unnecessary codes including unnecessary space codes if a code indicating that there is no input of information is input; and printing the document following editing of the document.

18. The method of claim 17, further including inputting all information required in the document prior to printing the document.

19. The method of claim 17, further including inputting only a portion of the information required in the document prior to printing the document.

* * * * *